United States Patent [19]

Miyagi

[11] 4,100,735

[45] Jul. 18, 1978

[54] SECONDARY AIR CONTROL SYSTEM IN AN INTERNAL COMBUSTION ENGINE

[75] Inventor: Hideo Miyagi, Susono, Japan

[73] Assignee: Toyota Jidosha Kogyo Kabushiki Kaisha, Toyota, Japan

[21] Appl. No.: 775,031

[22] Filed: Mar. 7, 1977

[30] Foreign Application Priority Data

Nov. 15, 1976 [JP] Japan ..... 51-136241

[51] Int. Cl.[2] ..... F01N 3/10; F02B 75/10

[52] U.S. Cl. ..... 60/276; 60/289; 60/290

[58] Field of Search ..... 60/276, 289, 290

[56] References Cited

U.S. PATENT DOCUMENTS

| | | | |
|---|---|---|---|
| 3,911,674 | 10/1975 | Goto | 60/290 |
| 3,931,710 | 1/1976 | Hartel | 60/290 |
| 3,962,867 | 6/1976 | Ikeura | 60/290 |

*Primary Examiner*—Douglas Hart

*Attorney, Agent, or Firm*—Stevens, Davis, Miller & Mosher

[57] ABSTRACT

A control system for adjusting the amount of a secondary air to be fed into the exhaust system, comprising a secondary air control valve (ACV) for controlling the amount of the secondary air from an air pump, vacuum switching valves (VSV) alternately effecting an operative vacuum on the ACV, and a vacuum control valve (VCV) which is connected to the VSV via a first vacuum reservoir tank and to the intake vacuum area via a second vacuum reservoir tank.

12 Claims, 11 Drawing Figures

Figure 1:
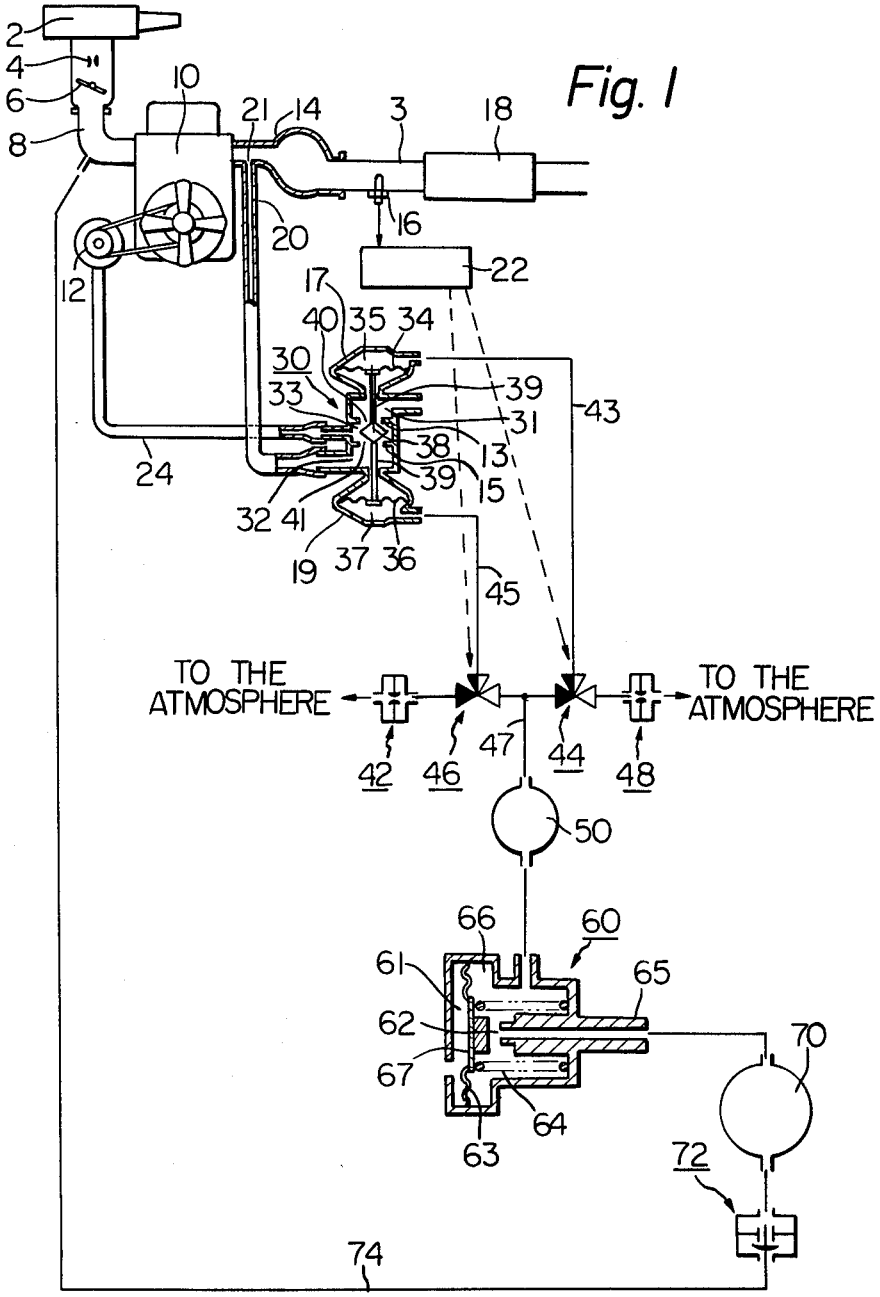

TO THE ATMOSPHERE
TO THE ATMOSPHERE

SECONDARY AIR CONTROL SYSTEM IN AN INTERNAL COMBUSTION ENGINE

This invention relates to a secondary air control system for an exhaust gas purifying device in an internal combustion engine.

In order to obtain an effective and efficient purifying operation in an internal combustion engine comprising an exhaust gas purifying device such as a reactor or a catalyzer, it is required to maintain the air-fuel ratio (A/F) of the exhaust gas, which is to be fed into the reactor or catalyzer, approximately at a stoichiometric A/F; or, strictly speaking, it is required to feed the exhaust gas, which is produced when the air-fuel mixture having a stoichiometric A/F is burnt, into the reactor or catalyzer. Hereinafter, the A/F of the exhaust gas will be referred to as a quasi-A/F, for the sake of convenience. In order to satisfy the above-described requirement, a known control system comprises an A/F sensor such as an oxygen sensor ($O_2$ sensor) or a carbon monoxide sensor (Co sensor) for detecting an $O_2$ concentration or a CO concentration and a control means in which the measurement of the $O_2$ concentration or CO concentration is compared with a predetermined standard. The control means produces a rich signal or a lean signal in response to a difference between the measurement and the standard, if any, to operate an actuator which, in turn, controls a cross-sectional area of a valve port of a secondary air control valve, thereby adjusting an amount of the secondary air to be fed into the exhaust system. In the known control system as mentioned above, the secondary air control valve comprises two chambers arranged on both sides of the valve body thereof, one of which is provided with a discharge port through which an excess secondary air escapes into an air-cleaner, the other chamber being provided with a feed port through which a secondary air is fed into the exhaust system. The secondary air introduced from an air pump is partially fed into the exhaust system, and the remainder is discharged into the air-cleaner, in response to a displacement of the valve body. The amount of the secondary air to be fed depends on the various driving conditions of the vehicle. For example, this amount is increased before the engine is warmed up or when the vehicle is being accelerated, and is decreased when the vehicle is being decelerated. According to the known control system, the cross-sectional area of the valve port and, accordingly, the stroke displacement of the valve body in the secondary air control valve depend on a pressure difference between the two diaphragm chambers which are provided adjacent to the chamber with the discharge port and adjacent to the chamber with the feed port, respectively. The diaphragm chambers are, in turn, operated by an intake vacuum through a vacuum switching valve (V.S.V.), so that the speed of the operation of the valve body of the secondary air control valve considerably depends on the magnitude of the intake vaccum. In other words, the speed of the operation of the valve increases when the intake vacuum is high, and vice versa. In addition, when the intake vacuum is high, the amount of the exhaust gas will remain small and, accordingly, the back pressure and the flow speed of the exhaust gas will remain low, provided that the rotation speed of the engine is kept constant. As a result, the time interval during which the secondary air-exhaust gas mixture reaches the A/F sensor, increases as the intake vacuum becomes higher.

Therefore, if the operative characteristics of the secondary air contrl valve are set in such a way that the most desirable characteristics are obtained under a condition of a high engine load and a low intake vacuum, the time interval during which the mixture reaches the A/F sensor will be increased. This is because the flow speed of the secondary air-exhaust gas mixture becomes lower as the engine load is decreased and the intake vacuum is increased. As a result, there is a difference between the quasi- A/F near the secondary air injection port and the quasi- A/F near the sensor. That is, the quasi- A/F which is detected by the sensor is not identical to a quasi-A/F near the injection port. Consequently, when the control means feeds back a rich or a lean signal in response to the detection by the A/F sensor, the exhaust gas-secondary air mixture tends to become lean or rich.

On the contrary, if the operative characteristics of the secondary air control valve are set in such a way that the most desirable characteristics are obtained under a condition of a low engine load and a high intake vacuum, a problem similar to that of the aforementioned way of setting the operative characteristics will also occur, that is, a difference between the quasi- A/F near the secondary air injection port and the quasi- A/F near the A/F sensor will occur.

This results in an unsatisfactory and inefficient purificating of the exhaust gas by the exhaust gas purifying device such as the catalyzer or the reactor and in an imprecise operation of the secondary air control valve.

Further, the required amount of a secondary air to be fed into the exhaust system suddenly increases when the driving condition of the vehicle is rapidly shifted from a low load driving to a high load driving, for example, from idling or deceleration to acceleration, or during suddern acceleration immediately after the gearshift change. However, it is impossible to determin the speed of the operation of the secondary air control valve for meeting such a particular condition. Known control sytems cannot be used to solve the problem wherein a supply of a large amount of secondary air is required under the particular condition as mentioned above to improve the CO emission.

An object of the present invention is to eliminate the drawbacks mentioned above.

Further advantages of the invention will become apparent from the detailed description which follows hereinafter.

Figure 2:
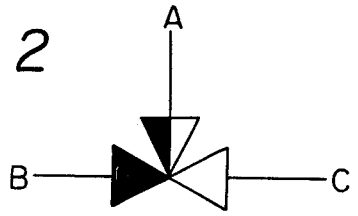
Figure 3:
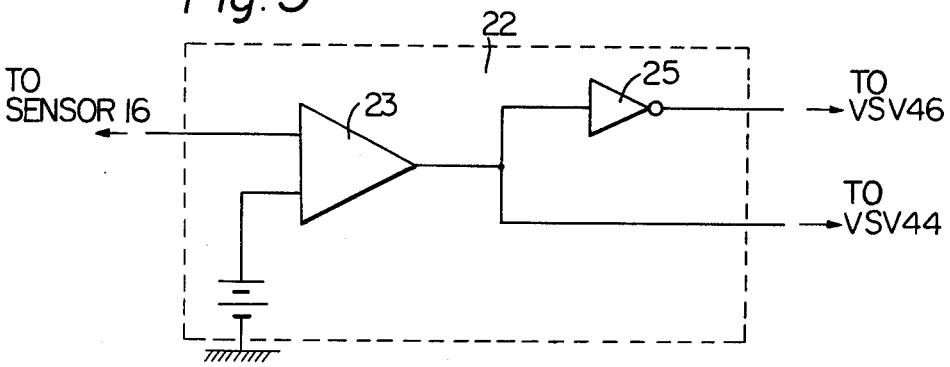
Figure 4A:
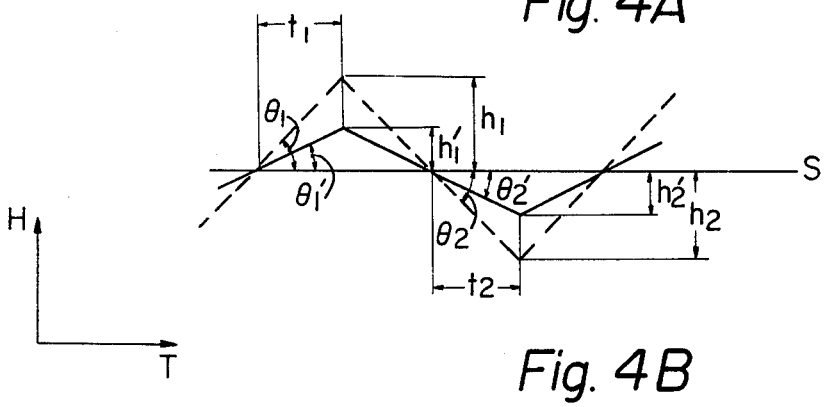
Figure 4B:
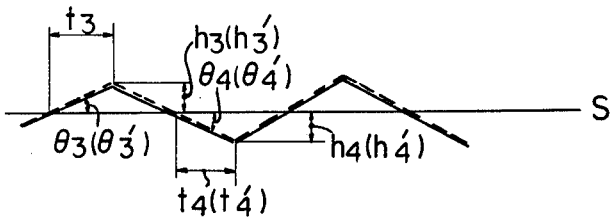
Figure 5:
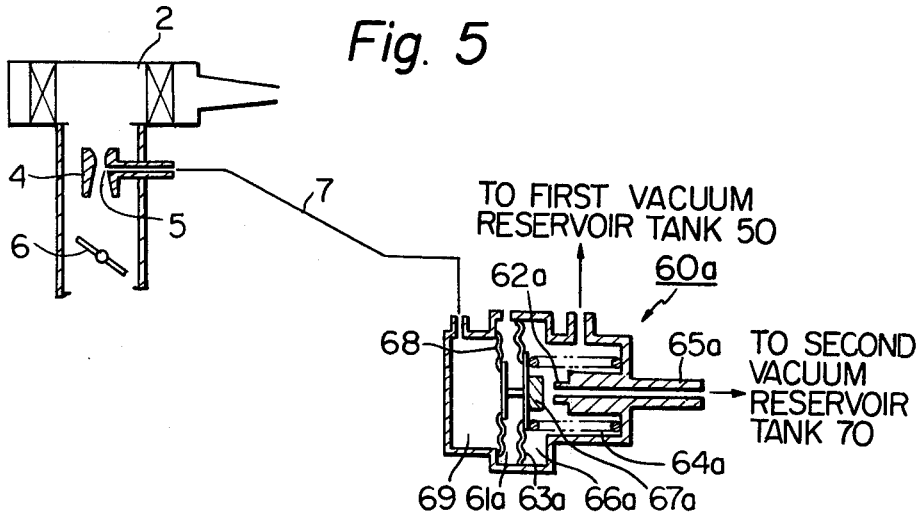
Figure 6:
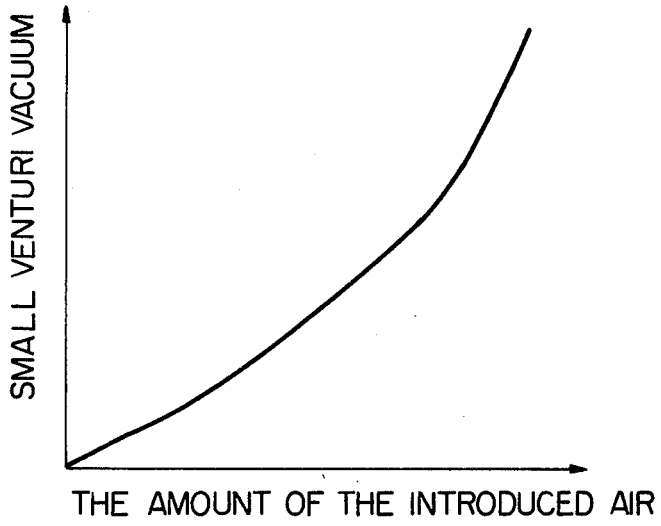
Figure 7A:
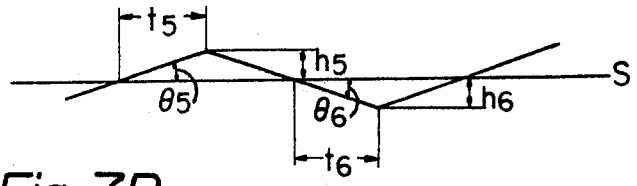
Figure 7B:
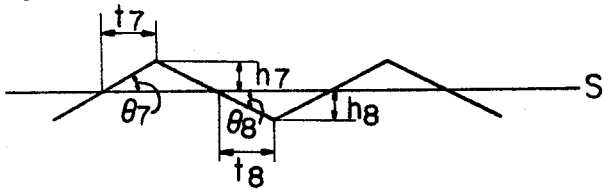
Figure 8:
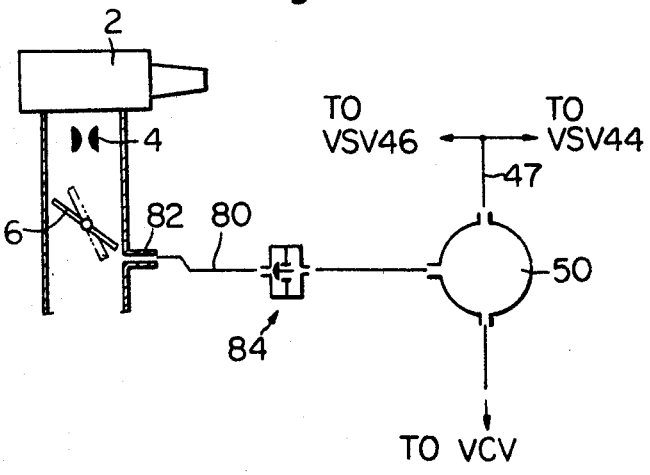
Figure 9:
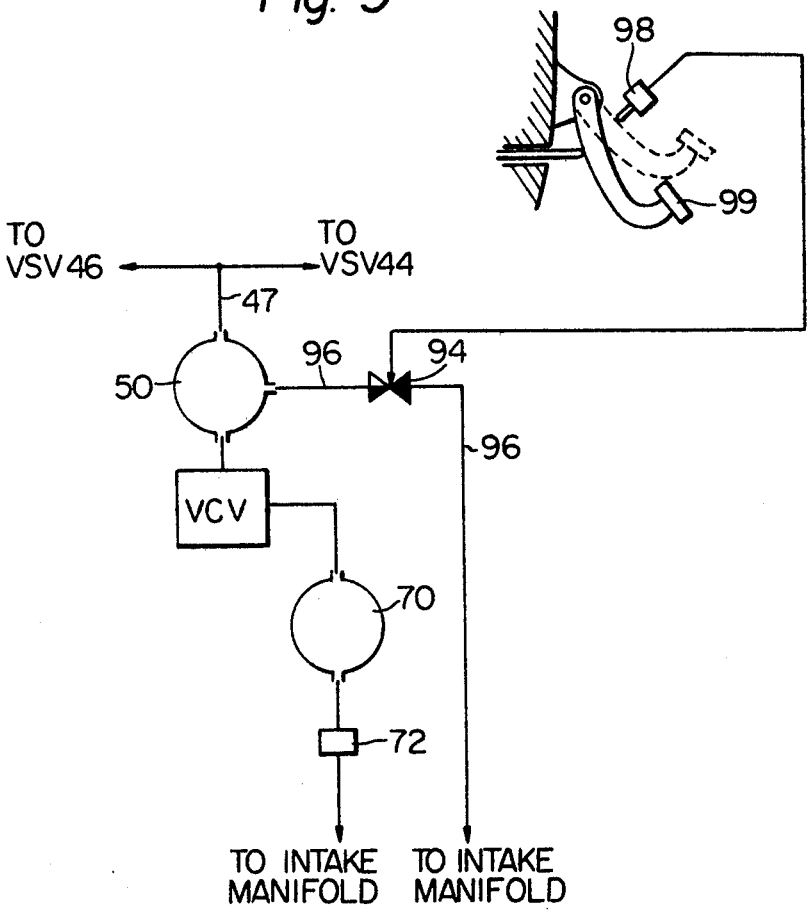

A number of embodiments of the invention are illustrated in the accompanying drawings in which:

FIG. 1 is a schematic view of a secondary air control system according to a first embodiment of the invention, FIG. 2 is an explanatory view showing an operation of a vacuum switching valve, FIG. 3 is an example of an electric circuit of a control computer, FIGS. 4A and 4B are diagrams showing the operational characteristics of a secondary air control valve in the control system shown in FIG. 1, in comparison with a prior art;

FIG. 4A being the case of the low engine load, and FIG. 4B being the case of the high load;

FIG. 5 is a schematic view of a part of a second embodiment of the invention, FIG. 6 is a diagram showing the relationship between a small venturi vacuum and an amount of the introduced air, FIGS. 7A and 7B are diagrams corresponding to FIGS. 4A and 4B, respectively, except that these diagrams are based on the second embodiment instead of the first, FIG. 8 is a schematic view of a part of a third embodiment of the invention, and FIG. 9 is a variant of FIG. 8.

Referring first to FIG. 1, 2 shows an air-cleaner, 3 an exhaust pipe, 4 a venturi, 6 a throttle valve, 8 an intake manifold, 10 an engine body, and 14 an exhaust manifold. A secondary air is injected through an injection port 21 of a secondary air conduit 20 and into the exhaust manifold 14. An $O_2$ sensor 16, which detects an $O_2$ concentration in the exhaust gas that is, in the exhaust gas-secondary air mixture, is arranged in the exhaust manifold 14 or the exhaust pipe 3 downstream of the injection port 21. The $O_2$ sensor 16 may be replaced by a CO sensor or any other A/F detecting sensors. Numeral 18 designates an exhaust gas purifying means such as a reactor or a cataly, per se known, for purifying the exhaust gas. However, this means is preferably a threeway catalyzer which not only oxidizes HC and CO but also deoxidizes $NO_x$. The $O_2$ sensor 16 may be installed either downstream or upstream of the three-way catalyzer 18. A certain distance is provided between the secondary air injection port 21 and the $O_2$ sensor 16 for performing an effective mixing of the secondary air with the exhaust gas.

The secondary air conduit 20 is connected to a chamber 32 of a secondary air control valve (ACV) 30. The ACV 30 comprises three chambers 31, 32, 33 which are divided by the partition walls 13 and 15 having valve ports 40 and 41, respectively. The partition walls serve as valve seats for a valve body 38. The chamber 31 is a discharge chamber connected directly or via the air-cleaner 2 to the atmosphere, and the intermediate chamber 33 is connected to an air pump 12 through a conduit 24. Provided adjacent to the discharge chamber 31 and the secondary air feeding chamber 32 are two diaphragm operation means 17 and 19, respectively, which are provided with diaphragms 34, 36 and diaphragm chambers 35, 37, respectively. Both ends of a valve stem 39 of the valve body 38 are connected to the diaphragms 34, 36, respectively. The valve body 38 positioned in the intermediate chamber 33 is moved with the displacement of the diaphragms 34 and 36 to vary the cross-sectional areas of the valve ports 40 and 41.

The diaphragm chambers 35 and 37 are connected to vacuum switching valves (VSV) 44 and 46, per se known, via pressure sensing pipes 43 and 45, respectively. Each of the VSV 44 and 46 is an electromagnetic three-way valve which is per se known and which operates in such a way that it establishes a pressure level connection between line "A" and line "B" when the valve is energized and a pressure level connection between line "A" and line "C" when the valve is de-energized, as shown in FIG. 2.

The output signal (voltage signal) from the $O_2$ sensor 16 is fed to the computer 22 which, for example, may comprise an electric circuit including a comparator 23 and an inverter 25, as shown in FIG. 3. Such a computer as shown in FIG. 3 is per se known. The output voltage from the $O_2$ sensor 16, i.e. the measurement is compared with a predetermined standard (voltage) by the comparator 23 in the computer 22. The computer 22 detects whether the actual mixture is lean or rich, i.e. the A/F equivalence ratio "λ" being defined as actual A/F ratio/stoichiometric A/F ratio is above or below 1 ($\lambda>1$ or $\lambda<1$), in response to a difference between the standard and the measurement, if there is any, and subsequently feeds a corresponding control signal to VSV 44 and 46, as shown by the dotted lines in FIG. 1. When $\lambda<1$ (rich), VSV 44 and 46 are energized, and when $\lambda>1$ (lean), VSV 44 and 46 are de-energized. The VSV 44 and 46 are provided with restriction means 48 and 42, respectively. Consequently, the restriction means are caused to communicate with the atmosphere. In addition, the operational characteristics of the valve body 38 can be properly set by suitably designing the reaction means 48 and 42.

The known control system also comprises a construction similar to the one explained above. However, according to the known control system, since the VSV 44 and 46 are directly connected to the intake manifold 8 by a pressure sensing pipe corresponding to the pipe 47 in FIG. 1 so that the speed of the operation of the valve body 38 depends directly on the degree of the intake manifold vacuum, problems as mentioned before will occur.

According to the present invention, as can be seen from FIG. 1, the VSV 44 and 46 are connected to a vacuum control valve (VCV) 60 via a pressure sensing pipe 47. The VCV 60 comprises an atmospheric chamber 61 and a diaphragm chamber 66 which is separated by a diaphragm 63 from the atmospheric chamber 61. The diaphragm chamber 66 is connected to a first vacuum reservoir tank 50 arranged in the pressure sensing pipe 47. To the diaphragm 63 is fixed a valve body 67 for opening and closing a valve port 62. A spring 64 which always presses the diaphragm 63 in a direction toward the atmospheric chamber 61 is provided in the diaphragm chamber 66. This diaphragm chamber 66 is connected through a passage 65 to a second vacuum reservoir tank 70, which is in turn, connected to the intake manifold 8 or to any other intake vacuum area via a pressure sensing pipe 74 having a check valve 72 therein. The check valve 72 opens only when the vacuum in the pressure sensing pipe 74 is stronger than that of the second vacuum reservoir tank 70 for storing the higher vacuum in the tank 70. Consequently, every time a higher vacuum develops in the intake manifold 8 or in any other intake vacuum areas, the higher vacuum is stored in the second vacuum reservoir tank 70.

This higher vacuum can usually be stored also in the first vacuum reservoir tank 50 when the valve port 62 of the VCV 60 is in an open position. However, the vacuum in the first vacuum reservoir tank 50 becomes weaker every time VSV 44 and 46 are alternately energized or de-energized. Accordingly, the vacuum in the diaphragm chamber 66 becomes small, and the spring 64 finally moves the diaphragm 63 with the valve body 67 against the vacuum in the diaphragm chamber 66, in a left-hand direction, as seen in FIG. 1, thereby opening the valve port 62. As a result, the high vacuum in the second vacuum reservoir tank 70 has such an influence over the diaphragm chamber 66 and the first vacuum reservoir tank 50 that the vacuum in the diaphragm chamber 66 can overcome the force of the spring 64, thereby closing the valve port 62 again. That is to say, the vacuum in the first vacuum reservoir tank 50 remains substantially constant. The first vacuum reservoir tank 50 is intended to minimize the fluctuations in the operative vacuum for VSV 44 and 46, while the second vacuum reservoir tank 70 is intended to ensure a required degree of the vacuum even when the intake vacuum becomes weaker or when the driving condition is shifted from low load to high load. When the computer 22 produces a "rich signal" which means that the actual secondary air-exhaust gas mixture is rich, VSV 44 and 46 are energized. As a result, VSV 44 causes the pipe 43 to communicate with the pipe 47, and VSV 45 causes the pipe 45 to communicate with the atmosphere via the restiction means 42. On one hand, the vacuum in the first vacuum reservoir tank 50 acts on the diaphragm chamber 35 of the ACV 30 through the pipe 43; on the other hand, the atmospheric pressure acts on the diaphragm chamber 37 of the ACV 30 through the VSV 46 which is now communicated with the atmosphere via the restriction means 42, thereby moving the valve body 38 upwardly together with the diaphragms 34 and 36 in FIG. 1. As a result, the valve port 41 becomes larger, and the valve port 40 becomes smaller. This results in an increase in the amount of the secondary air which is fed from the air pump 12 via the conduit 24 into the intermediate chamber 33, then flows through the valve port 41 and the feeding chamber 32 into the secondary air conduit 20, and is injected from the secondary air injection port 21. Thus, the secondary air-exhaust gas mixture becomes lean. The remainder of the secondary air is discharged through the valve port 40 and through the discharging chamber 31 into the atmosphere.

Contrary to the above description of a "rich signal", when the computer 22 produces a "lean signal" which means that the actual mixture is lean, VSV 44 and 46 are de-energized. As a result, VSV 44 causes the pipe 43 to communicates with the atmosphere via the restriction means 48, while VSV 46 causes the pipe 45 to communicate with the pipe 47. Consequently, the vacuum in the first vacuum reservoir tank 50 acts on the diaphragm chamber 37 through the pipe 45, and the atmosphere acts on the diaphragm chamber 35 through the restriction means 48 and the pipe 43. As a result, the valve body 38 moves downwardly in FIG. 1, thereby increasing the cross-sectional area of the valve port 40 and decreasing that of the valve port 41. Thus, the amount of secondary air injected from the injection port 21 decreased to make the exhaust gas rich.

As can be understood from the above description, since the vacuum in the diaphragm chambers 35 and 37 for operating the valve body 38 of the ACV 30 is maintained substantially constant without being subjected to the influence of the fluctuation of the intake vacuum and, accordingly, of the engine load, the speed of the operation of the valve body 38 can also be maintained substantially at constant. That is, the operational speed of the valve body 38 is substantially constant regardless of the engine load conditions, and, accordingly, the difference in the displacement of the valve body 38 between when the engine load is high and when the engine load is low, becomes small. These operational characteristics will be explained in detail with reference to FIGS. 4A and 4B.

FIGS. 4A and 4B show the relationships between the time T and the displacement H of the valve body 38 when subjected to the condition of low load (high intake vacuum), and to the condition of high load (low intake vacuum), respectively. In FIGS. 4A and 4B, the dotted lines show a prior art in which the pressure sensing pipe 47 (FIG. 1) is directly connected to the intake manifold, and the solid lines show our invention, particularly the first embodiment thereof shown in FIG. 1. The horizontal line S shows a position of the valve body 38 corresponding to the stoichiometric point.

Angle $\theta$ ($\theta_1$, $\theta_1'$, $\theta_2$, $\theta_2'$, $\theta_3$, $\theta_3'$. . . ) is an angle determined by the operational speed of the valve body 38 and which can be adjusted by properly designing the restriction means 42 and 48. According to the prior art, once the angle $\theta$ is set, since the operational speed of the valve body is high when the intake vacuum is high, as mentioned before, an inequality $\theta_1 > \theta_3$ will always be established. Whereas, according to our invention, since the operational speed of the valve body 38 is always substantially constant, independent of the fluctuation of the intake vacuum, a relationship $\theta_1' = \theta_3'$ can be obtained. It should be noted herein that the time interval during which the valve body continues to operate is increased as the intake vacuum is high, since the speed of a current of the exhaust gas becomes lower as the intake vacuum becomes higher, as mentioned before. This condition can also be applied to the control system shown in FIG. 1. That is, an inequality $t_1 > t_3$ is obtained. As is apparent from the above, according to the prior art, since two inequalities $\theta_1 > \theta_3$ and $t_1 > t_3$ are established, an inequality $h_1 > h_3$ is obtained. The difference between $h_1$ and $h_3$ ($h_1 - h_3$) is considerably large. Whereas, according to the present invention, an inequality $h_1' > h_3'$ is similarly obtained from the relationships $t_1 > t_3$ and $\theta_1' = \theta_3'$, but the difference between $h_1'$ and $h_3'$ ($h_1' - h_3'$) is considerably small because of $\theta_1' = \theta_3'$. That is, $h_1'$ is far smaller than $h_1$. There are two possibilities in accordance with engine requirements wherein the "rich signal" control represented by $\theta_1$ ($\theta_1'$, $\theta_3$, $\theta_3'$) is identical to or different from the "lean signal" control represented by $\theta_2$ ($\theta_2'$, $\theta_4$, $\theta_4'$). These possibilities can be easily achieved by adjusting the restriction means 42 and 48. It will be easily understood from the above-mentioned explanation concerning the "rich signal" control that a similar relationship can also be obtained in the "lean signal" control wherein $h_2'$ is far smaller than $h_2$. As is apparent from the aforementioned description, according to the present invention, the difference in the displacement of the valve body 38 between when the intake vacuum is high and when the intake vacuum is low, is relatively small; accordingly, the fluctuation of the A/F ratio is small.

However, a problem remains in the first embodiment wherein if the speed of the operation of the valve body 38 is set in such a way that it is satisfactory when the intake vacuum is low, the fluctuation of A/F ratio will be considerably decreased, but the overshoot H of the valve 38 will increase under low load and low engine speed, i.e. when the amount of the exhaust gas is small because the time T has increased. In order to solve this problem, a second embodiment of the invention is provided as shown in FIG. 5, in which the speed of the operation of the valve body 38 is descreased when the amount of the exhaust gas is small, and vice versa.

The second embodiment will now be explained with reference to FIG. 5.

The control system partially shown in FIG. 5 is substantially the same as that of FIG. 1, except that the VCV 60 of FIG. 1 is replaced by VCV **60*a*. Components of VCV 60*a* which correspond to the components of VCV 60 (FIG. 1**) are shown by reference numerals with the smaller case "*a*".

The vacuum control valve **60*a* comprises a first diaphragm chamber 66*a*, an atmospheric chamber 61*a*, and a second diaphragm chamber or the venturi vacuum chamber 69, these three chambers being divided by diaphragms 63***a* and 68. The first diaphragm chamber 66*a* is connected to the first vacuum reservoir tank 50 of FIG. 1 (not shown in FIG. 5) and is also connected to the second vacuum reservoir tank 70 of FIG. 1 (not shown in FIG. 5) through the pipe 65*a*. The diaphragm 63*a* is connected to the diaphragm 68 and moves therewith. The second diaphragm chamber, i.e. the venturi vacuum chamber 69, is connected to a venturi, preferably, a small venturi 4 of a carburator via a pressure sensing pipe 7. The reason why the small venturi is more preferable to a large venturi is that the small venturi vacuum is usually larger than the large venturi vacuum. In short, the VCV 60*a* of the control system shown in FIG. 5 substantially is equivalent to a combination of the venturi vacuum chamber 69 with the diaphragm 68 and the VCV 60 shown in FIG. 1.

As can be seen from FIG. 6, it is known that the small venturi vacuum increases as the amount of the introduced air is increased. On the other hand, the amount of the exhaust gas decreases or increases in proportion to the decrease or the increase of the amount of the introduced air, and, accordingly, the small venturi vacuum becomes high when the amount of the exhaust gas becomes large, and vice versa. Consequently, the vacuum in the venturi vacuum chamber 69 is low when the amount of the exhaust gas is small. When the valve port 62*a* is closed, the vacuum in the first diaphragm chamber 66*a* increases proportionally to the increase of the vacuum in the venturi vacuum chamber 69, and vice versa. Since the speed of operation of the valve body 38 (FIG. 1) depends on the degree of the vacuum acting on the diaphragm chamber 35 or 37 in the ACV 30 (FIG. 1), the speed increases as the vacuum in the first diaphragm chamber 66*a* of the VCV 60*a* is increased. That is, the speed of the operation of the valve body 38 (FIG. 1) decreases when the amount of the exhaust gas is small. On the contrary, the speed of operation of the valve body 38 increases as the vacuum in the venturi vacuum chamber 69 is increased, since the vacuum in the first diaphragm chamber 66*a* is also increased.

FIGS. 7A and 7B are views corresponding to FIGS. 4A and 4B, respectively, with respect to the second embodiment shown in FIG. 5. That is, FIGS. 7A and 7B show the relationships between the time T and displacement H of the valve body 38 at a condition of low load (high intake vacuum) and at a condition of high load (low intake vacuum), respectively. According to the second embodiment, since the speed of the operation of the valve body 38 increases as the engine load is increased, an inequality $\theta_5<\theta_7$ ($\theta_6<\theta_8$) is obtained. On the other hand, a relationship $t_5<t_7$ is similarly established in FIGS. 7A and 7B, and a relationship $h_5=h_7$ ($h_6=h_8$) can be established by properly selecting T and $\theta$. That is to say, it is possible to maintain the displacement H of the valve body 38 substantially at a constant which is independent of the engine load, and to minimize the fluctuation of the engine quasi A/F. In FIG. 5, the second diaphragm chamber 69 is connected to the small venturi 4 but may be connected to a large venturi, an exhaust gas pressure area or any other portion of the engine which is capable of producing a parameter signal corresponding to the variation of an amount of the introduced air or an amount of the exhaust gas.

Since the required amount of the secondary air rapidly increases when the driving condition of the engine is shifted from idling or deceleration to acceleration, or when the engine is accelerated immediately after the shift, as mentioned before, it is desirable to additionally increase the speed of the operation of the valve body 38 of the ACV 30 only at the amount when the vehicle is subjected to such a condition.

In order to achieve the above objective there is provided a third embodiment shown in FIG. 8. In FIG. 8, the first vacuum reservoir tank 50 shown in FIG. 1 is connected to a port 82 via a pressure sensing pipe 80 provided with a check valve or a one-way valve 84. Except for this construction, the third embodiment shown in FIG. 8 is similar to the first embodiment shown in FIG. 1 or to the second embodiment shown in FIG. 5. That is, the first vacuum reservoir tank 50 may be connected to VCV 60 in FIG. 1 or to 60*a* in FIG. 5. Preferably, the port 82 is provided in a position in which the port is opened slightly downstream of the throttle valve 6 which is in an idling position. The position of the port 82 corresponds, therefore, to a position of a so-called "throttle positioner port". As a result, a high intake vacuum can be directly stored in the first vacuum reservoir tank 50 without passing through the VCV, only when the throttle valve 6 is in an idling position. If the throttle valve 6 is opened at a degree larger than the idling angle, no intake vacuum is acting on the port 82 and the check valve 84 is closed to disconnect the reservoir tank 50 from the port 82. Since almost all of the driving conditions which require a rapid increase of the required amount of the secondary air happen when the throttle valve is changed from an idling position or a closed position to a partially opened position or a fully opened position, the speed of the operation of the valve body can be additionally increased only under the above-mentioned driving conditions by increasing the operative intake vacuum.

FIG. 9 shows a variant of FIG. 8 and achieves the same objects as those in FIG. 8, that is, the aims to additionally increase the speed of operation of the valve body of the ACV only when a required amount of secondary air is rapidly increased. In FIG. 9, the first vacuum reservoir tank 50 is connected to the intake vacuum area such as the intake manifold 8 (FIG. 1) via a pressure sensing pipe 96 provided with a vacuum switching valve (VSV) 94. Also in FIG. 9, the VCV to which the tank 50 is to be connected, may be the VCV 60 (FIG. 1) or the VCV 60*a* (FIG. 5). The VSV 94 which may be in the form of an electromagnetic valve, per se known, is designed in such a way that it is turned "ON" when the clutch pedal 99 is depressed, and is turned "OFF" when the clutch pedal is released. The signal for activating the "ON" or "OFF" signal in the VSV 94 is produced by a clutch switch 98. The clutch switch 98 produces an "ON" signal when the clutch pedal 99 is depressed and an "OFF" signal when the clutch pedal 99 is released. The embodiment shown in FIG. 9 has been created in accordance with the fact that acceleration from idling or deceleration, or acceleration occurring immediately after a shift change usually begins after releasing the clutch pedal which has been depressed, particularly in the case of a foot clutch. In this embodiment, the intake vacuum can be stored in the first vacuum reservoir tank 50 only when the clutch pedal is depressed.

As is apparent from the above description, according to the present invention, it is possible to maintain the speed of the operation of the valve body of the secondary air control valve at substantially constant within a wide range of driving conditions. It is also possible to vary the speed of the operation of the valve body in accordance with the driving conditions, by controlling the operative intake vacuum acting on the diaphragm chambers of the secondary air control valve, thereby to effectively and precisely control the amount of the secondary air to be fed into the exhaust system, resulting in an improvement of the purifying efficiency of the exhaust gas purifying device such as a reactor, a catalyzer or a three-way catalyzer. In addition, the present invention can fully satisfy the required rapidly increasing amount of the necessary secondary air by increasing the operative intake vacuum of the secondary air control valve within a short interval of time immediately after acceleration from idling or deceleration, or acceleration starting immediately after a shift change, to increase the speed of the operation of the valve body of the secondary air control valve.

What is claimed is:

1. A secondary air control system in an internal combustion engine comprising a diaphragm-operated secondary air control valve for feeding a controlled amount of secondary air from an air pump into an exhaust system of the engine and a vacuum switching valve means for alternately switching circuits of an operative vacuum which acts on said secondary air control valve, in response to the A/F equivalence ratio λ of the exhaust gas, wherein the improvement comprises a vacuum control valve provided with a diaphragm chamber which is connected to said vacuum switching valve means via a first vacuum reservoir tank and is connected to an intake vacuum area via a second vacuum reservoir tank having a check valve which opens only when the intake vacuum is stronger than the vacuum in the second vacuum reservoir tank for storing the higher vacuum in said secondary vacuum reservoir tank, the connection of said diaphragm chamber of said vacuum control valve and said second vacuum reservoir tank being established only when said vacuum control valve is in an open position, said vacuum control valve being opened when the vacuum in said first vacuum reservoir tank reaches below a predetermined value thus filling said first vacuum reservoir tank with the higher vacuum stored in said second vacuum reservoir tank, and resulting in maintaining the operative vacuum in said first vacuum reservoir tank substantially constant.

2. A secondary air control system as set forth in claim 1, wherein said diaphragm operated-secondary air control valve comprises three chambers, first of which being connected to said air pump, the second being connected to a secondary air injection port opened into the exhaust system to serve as a secondary air feeding chamber and the third being connected to the atmosphere to serve as a secondary air discharging chamber; valve port for feeding and discharging the secondary air, provided between the first and the second chambers, and between the first and the third chambers, respectively; diaphragm operation means provided adjacent to the second and the third chambers, respectively, said diaphragm operation means being provided with diaphragm chambers with diaphragms connected to said vacuum switching valve means; and a valve body movable with said diaphragms of said diaphragm chambers of the diaphragm operation means for varying the cross-sectional areas of said valve ports in response to said operative vacuum to control the amount of the secondary air to be injected from said secondary air injection port; wherein said vacuum switching valve means comprises an electromagnetic three-way valve means which can be alternately connected to the atmosphere or to said first vacuum reservoir tank.

3. A secondary air control system as set forth in claim 2, wherein said vacuum control valve comprises a diaphragm chamber with a spring-biased diaphragm connected to said first vacuum reservoir tank, and a valve body fixed to said diaphragm to open and close a valve port connected to said second vacuum reservoir tank, whereby said valve port is opened only when the spring force biasing said diaphragm is stronger than the vacuum in said diaphragm chamber.

4. A secondary air control system in an internal combustion engine comprising a diaphragm-operated secondary air control valve for feeding a controlled amount of secondary air from an air pump into an exhaust system of the engine and a vacuum switching valve means for alternately switching circuits of an operative vacuum which acts on said secondary air control valve, in response to the A/F equivalence ratio λ of the exhaust gas, wherein the improvement comprises a vacuum control valve provided with a first diaphragm chamber which is connected to said vacuum switching valve means via a first vacuum reservoir tank and is connected to an intake vacuum area via a second vacuum reservoir tank having a check valve which opens only when the intake vacuum is stronger than the vacuum in the second vacuum reservoir tank for storing the higher vacuum in said second vacuum reservoir tank, the connection of said diaphragm chamber of said vacuum control valve and said second vacuum reservoir tank being established only when said vacuum control valve is in an open position, said vacuum control valve comprising a second diaphragm chamber which is arranged adjacent to said first diaphragm chamber and which is connected to a venturi vacuum area of a carburetor, the diaphragms of said first diaphragm chamber and of said second diaphragm chamber being fixed to each other, said vacuum control valve being opened when the vacuum in said first vacuum reservoir tank is below a predetermined value to fill the first vacuum reservoir tank with a high vacuum stored in said second vacuum reservoir tank, said first vacuum reservoir tank being filled with a vacuum which is higher by a degree of a vacuum corresponding to said venturi vacuum when said venturi vacuum acts on said second diaphragm chamber.

5. A secondary air control system as set forth in claim 4, wherein said diaphragm-operated secondary air control valve comprises three chambers, first of which being connected to said air pump, the second being connected to a secondary air injection port opened into the exhaust system to serve as a secondary air feeding chamber and the third being connected to the atmosphere to serve as a secondary air discharging chamber; valve ports for feeding and discharging the secondary air provided between the first and the second chambers and between the first and the third chambers, respectively; diaphragm operation means provided adjacent to the second and the third chambers, respectively, said diaphragm operation means being provided with diaphragm chambers with diaphragms connected to said vacuum switching valve means; and a valve body movable with said diaphragms of said diaphragm chambers of the diaphragm operation means for varying the cross-sectional areas of said valve ports in response to said operative vacuum to control the amount of the secondary air to be injected from said secondary air injection port; wherein said vacuum switching valve means comprises a three-way electromagnetic valve means which can alternately be connected to the atmosphere or to said first vacuum reservoir tank.

6. A secondary air control system in an internal combustion engine comprising a diaphragm-operated secondary air control valve for feeding a controlled amount of secondary air from an air pump into an exhaust system of the engine and a vacuum switching valve means for alternately switching circuits of an operative vacuum which acts on said secondary air control valve, in response to the A/F equivalence ratio λ of the exhaust gas, wherein the improvement comprises a vacuum control valve provided with a diaphragm chamber which is connected to said vacuum switching valve means via a first vacuum reservoir tank and is connected to an intake vacuum area via a second vacuum reservoir tank having a check valve which opens only when the intake vacuum is stronger than the vacuum in the second vacuum reservoir tank for storing the higher vacuum therein, the connection of said diaphragm chamber of said vacuum control valve and said second vacuum reservoir tank being established only when said vacuum control valve is in an open position, said first vacuum reservoir tank being connected to a port provided slightly downstream of a throttle valve of a carburetor which is in an idling position, via a check valve which opens only when said port vacuum is stronger than the vacuum in said first vacuum reservoir tank for storing the higher port vacuum therein, without being subjected to the vacuum from said second vacuum reservoir tank.

7. A secondary air control system as set forth in claim 6, wherein said vacuum control valve comprises a diaphragm chamber with a spring-biased diaphragm connected to said first vacuum reservoir tank, and a valve body fixed to said diaphragm to open and close a valve port connected to said second vacuum reservoir tank, whereby said valve port is opened only when the spring force biasing said diaphragm is stronger than the vacuum in said diaphragm chamber.

8. A secondary air control system as set forth in claim 6, wherein said vacuum control valve comprises a first diaphragm chamber with a spring-biased diaphragm connected to said first vacuum reservoir tank, a valve body fixed to said diaphragm to open and close a valve port connected to said second vacuum reservoir tank, and a second diaphragm chamber arranged adjacent to said first diaphragm chamber and which is connected to a venturi vacuum area of the carburetor, the diaphragms of said first diaphragm chamber and of said second diaphragm chamber bieng fixed to each other.

9. A secondary air control system in an internal combustion engine comprising a diaphragm-operated secondary air control valve for feeding a controlled amount of secondary air from an air pump into an exhaust system of the engine and a vacuum switching valve means for alternately switching circuits of an operative vacuum which acts on said secondary air control valve, in response to the A/F equivalence ratio λ of the exhaust gas, wherein the improvement comprises a vacuum control valve provided with a diaphragm chamber which is connected to said vacuum switching valve means via a first vacuum reservoir tank and is connected to an intake vacuum area via a second vacuum reservoir tank having a check valve which opens only when the intake vacuum is stronger than the vacuum in the secondary vacuum reservoir tank for storing the higher vacuum therein, the connection of said diaphragm chamber of said vacuum control valve and said second vacuum reservoir tank being established only when said vacuum control valve is in an open position, said first vacuum reservoir tank being connected to said intake vacuum area via a vacuum switching valve which operates in response to the movement of a clutch pedal, to store the intake vacuum in said first vacuum reservoir tank, without being subjected to the vacuum from said second vacuum reservoir tank.

10. A secondary air control system as set forth in claim 9, wherein said vacuum control valve comprises a diaphragm chamber with a spring-biased diaphragm connected to said first vacuum reservoir tank, and a valve body fixed to said diaphragm to open and close a valve port connected to said second vacuum reservoir tank, whereby said valve port is opened only when the spring force biasing said diaphragm is stronger than the vacuum in said diaphragm chamber.

11. A secondary air control system as set forth in claim 9, wherein said vacuum control valve comprises a first diaphragm chamber with a spring-biased diaphragm connected to said first vacuum reservoir tank, a valve body fixed to the diaphragm to open and close a valve port connected to said second vacuum reservoir tank, and a second diaphragm chamber which is arranged adjacent to said first diaphragm chamber and which is connected to a venturi vacuum area of the carburetor, the diaphragms of said first diaphragm chamber and of said second diaphragm chamber being fixed to each other.

12. A secondary air control system as set forth in claim 1, wherein said vacuum control valve comprises a diaphragm chamber with a spring-biased diaphragm connected to said first vacuum reservoir tank, and a valve body fixed to said diaphragm to open and close a valve port connected to said second vacuum reservoir tank, whereby said valve port is opened only when the spring force biasing said diaphragm is stronger than the vacuum in said diaphragm chamber.

* * * * *